US009396861B2

(12) United States Patent
Liang et al.

(10) Patent No.: US 9,396,861 B2
(45) Date of Patent: Jul. 19, 2016

(54) ENGAGING MODULE

(71) Applicant: Wistron Corporation, New Taipei (TW)

(72) Inventors: Chen-Yi Liang, New Taipei (TW); Chun-Kuan Liu, New Taipei (TW)

(73) Assignee: Wistron Corporation, Hsichih (TW)

( * ) Notice: Subject to any disclaimer, the term of this patent is extended or adjusted under 35 U.S.C. 154(b) by 0 days.

(21) Appl. No.: 14/595,210

(22) Filed: Jan. 13, 2015

(65) Prior Publication Data

US 2016/0099097 A1 Apr. 7, 2016

(30) Foreign Application Priority Data

Oct. 1, 2014 (TW) ..... 103217499 U

(51) Int. Cl.
*H01F 1/00* (2006.01)
*H01F 7/20* (2006.01)

(52) U.S. Cl.
CPC ..... *H01F 7/20* (2013.01)

(58) Field of Classification Search
CPC ..... Y10T 292/1021
USPC ..... 335/219
See application file for complete search history.

(56) References Cited

U.S. PATENT DOCUMENTS 3,358,254 A * 12/1967 Rupp ..... H01F 7/1607 335/253
4,800,741 A * 1/1989 Kerschenbaum ... E05B 47/0002 292/1.5
5,044,678 A * 9/1991 Detweiler ..... E05B 47/026 292/144
5,249,831 A * 10/1993 Maniaci ..... E05B 15/0093 109/59 R
5,532,521 A * 7/1996 Leininger ..... B60P 3/03 180/289
5,664,811 A * 9/1997 Martus ..... B60K 15/05 292/144
5,812,356 A * 9/1998 O'Connor ..... G06F 1/1632 335/179
7,332,990 B2 * 2/2008 Lo ..... E05C 19/16 24/303
7,562,918 B2 * 7/2009 Toma ..... E05B 47/0047 292/340

* cited by examiner

*Primary Examiner* — Alexander Talpalatski
(74) *Attorney, Agent, or Firm* — Jianq Chyun IP Office

(57) ABSTRACT

An engaging module is suitable for first and second objects adapted to be combined or separated along a first axial direction. The engaging module includes an engaging component, an elastic component and an electromagnet. The engaging component is movably disposed on the first object. When the first object and the second object are combined, the engaging component is adapted to move to a first position along a plane to be engaged with the second object, and is adapted to move to a second position along the plane to separate from the second object. The first axial direction is not parallel to the plane. The engaging component is positioned at the first position through an elastic force of the elastic component, and is adapted to resist the elastic force of the elastic component to be positioned at the second position through a magnetic force generated by the electromagnet.

18 Claims, 9 Drawing Sheets

ENGAGING MODULE

CROSS-REFERENCE TO RELATED APPLICATION

This application claims the priority benefit of Taiwan application serial no. 103217499, filed on Oct. 1, 2014. The entirety of the above-mentioned patent application is hereby incorporated by reference herein and made a part of this specification.

BACKGROUND

1. Field of the Invention

The invention is directed to an engaging module and more particularly, to an engaging module including an electromagnet.

2. Description of Related Art

Along with the developments of semiconductor devices and display technologies, electronic apparatuses are continuously developed toward being small-size, multi-functional and conveniently portable. The commonly available portable electronic apparatuses include tablet computers (tablet PCs), smart phones, notebook computers (NBs) and so on.

Generally, components of an electronic apparatus may be combined through a hook. In order to assemble or disassemble the hook and the corresponding component by means of elastic deformation of the hook itself, the amount of interference between the hook and the corresponding component is limited by the amount of elastic deformation of the hook when they are engaged with each other, which leads to affection on the engaging capability. Moreover, in a design using the hook for appearance engagement, a portion of the hook has to be exposed for a user to apply a force to the hook, which causes affection to the appearance of the electronic apparatus. On the other hand, in a design of the internal hook of the electronic apparatus, the minimum length of the hook is limited for the hook to have sufficient elastic deformation, which is unfavorable for thinning the appearance of the electronic apparatus. Moreover, the internal hook tends to be fractured easily by the force applied by the user during the disassembly process.

SUMMARY

The invention provides an engaging module with good engaging capability, of which an engaging component can prevent from being fractured during an assembling and disassembling process, and an apparatus applying the engaging module can have better appearance.

The invention is directed to an engaging module suitable for a first object and a second object. The first object and the second object are adapted to be combined or separated along a first axial direction. The engaging module includes an engaging component, an elastic component and at least one electromagnet. The engaging component is movably disposed on the first object. When the first object and the second object are combined, the engaging component is adapted to move along a plane to a first position to be engaged with the second object and adapted to move to a second position along the plane to separate from the second object. The first axial direction is not parallel to the plane. The elastic component is connected between the engaging component and the first object. The engaging component is positioned at the first position through an elastic force of the elastic component. The at least one electromagnet is disposed on the first object. The engaging component is adapted to resist the elastic force of the elastic component to be positioned at the second position through a magnetic force generated by the electromagnet.

In an embodiment of the invention, the first axial direction is perpendicular to the plane.

In an embodiment of the invention, the second object has an engaging slot. When the second object moves along the first axial direction toward the first object, the second object pushes the engaging component to drive the engaging component to resist the elastic force of the elastic component to move toward the second position. When the second object combined with the first object, the engaging component is aligned to the engaging slot and moves to the first position through the elastic force of the elastic component to be engaged with the engaging slot.

In an embodiment of the invention, the engaging component has a guide surface. The guide surface is inclined with respect to the first axial direction and the plane, the second object is adapted to push the guide surface to drive the engaging component to resist the elastic force of the elastic component to move toward the second position.

In an embodiment of the invention, a material of the engaging component comprises a magnetized material.

In an embodiment of the invention, the engaging component comprises a main body and a magnetized member, the main body has a containing slot, and the magnetized member is disposed in the containing slot.

In an embodiment of the invention, the engaging component is slidably disposed on the first object along a second axial direction. The second axial direction is parallel to the plane.

In an embodiment of the invention, the engaging component has a pillar extending along the second axial direction, the elastic component is a compression spring fitted around the pillar.

In an embodiment of the invention, the number of the at least one electromagnet is two, and the two electromagnets are respectively located on two opposite sides of the pillar.

In an embodiment of the invention, the engaging component is pivoted to the first object along the third axial direction. The third axial direction is perpendicular to the plane.

In an embodiment of the invention, the engaging component has a pivoted end and a free end. The pivoted end is pivoted to the first object along the third axial direction, and the elastic component is an elastic piece and leans against the free end.

In an embodiment of the invention, the engaging module includes a first electrical connection portion and a second electrical connection portion. The first electrical connection portion is disposed on the first object and electrically connected with the electromagnet, and the second electrical connection portion is disposed on the second object and electrically connected with a power supply. When the first object and the second object are combined, first electrical connection portion the first electrical connection portion contacts the second electrical connection portion, such that the electromagnet is adapted to receive electricity from the power supply. When the first object is separated from the second object, the first electrical connection portion does not contact the second electrical connection portion.

To sum up, in the engaging module of the invention, the objects are assembled and dissembled through the movement of the engaging component, instead of by using elastic deformation of a hook itself in the way like the conventional hook does. Thus, the amount of interference between the engaging component and the object interfered with each other is not limited and therefore, have better engaging capability. In addition, since the engaging module is not operated through the elastic deformation of the engaging component as described above, the minimum length of the engaging component is not limited by the need of the elastic deformation, which contributes to thinning the appearance of an apparatus applying the engaging module. Moreover, in the engaging module of the invention, the engaging component is driven to move by using the magnetic force generated by the electromagnet, instead of by using a force applied by a user, and thus, the engaging component can be prevented from being fractured due to the force applied by the user. Meanwhile, the engaging component does not have to be exposed for the user to apply the force, such that the apparatus applying the engaging module may have better appearance.

In order to make the aforementioned and other features and advantages of the invention more comprehensible, several embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
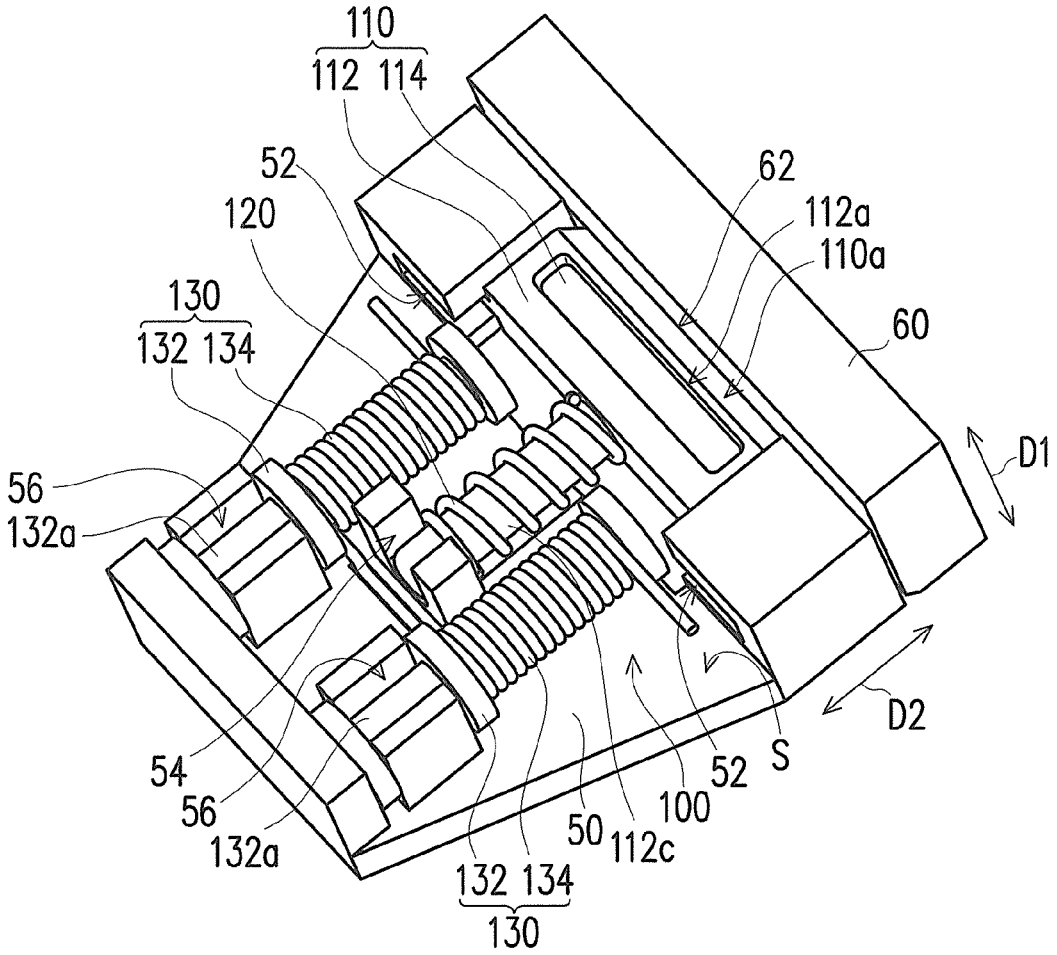
FIG. 1 is perspective diagram illustrating an engaging structure according to an embodiment of the invention.
Figure 2:
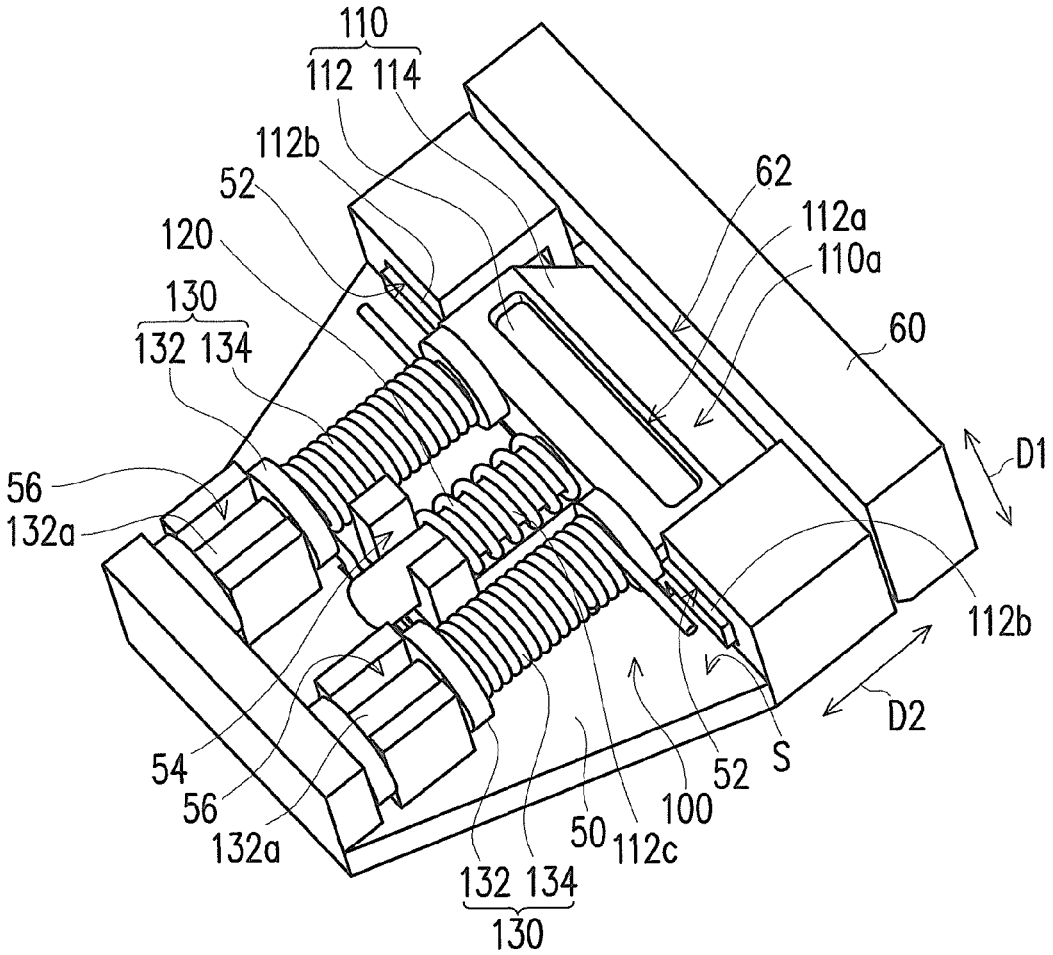
FIG. 2 illustrates a scenario that an engaging component of FIG. 1 is separated from the second object.

FIG. 1 is perspective diagram illustrating an engaging structure according to an embodiment of the invention. FIG. 2 illustrates a scenario that an engaging component of FIG. 1 is separated from the second object. Referring to FIG. 1 and FIG. 2, an engaging module 100 of the present embodiment is suitable for a first object 50 and a second object 60. The engaging module 100 includes an engaging component 110, an elastic component 120 and at least one electromagnet 130 (illustrated as two in this case). The engaging component 110 is movably disposed on the first object 50, and a material of the engaging component 110 includes a magnetized material. The elastic component 120 is connected between the engaging component 110 and the first object 50, and the electromagnets 130 are disposed on the first object 50.

Figure 3:
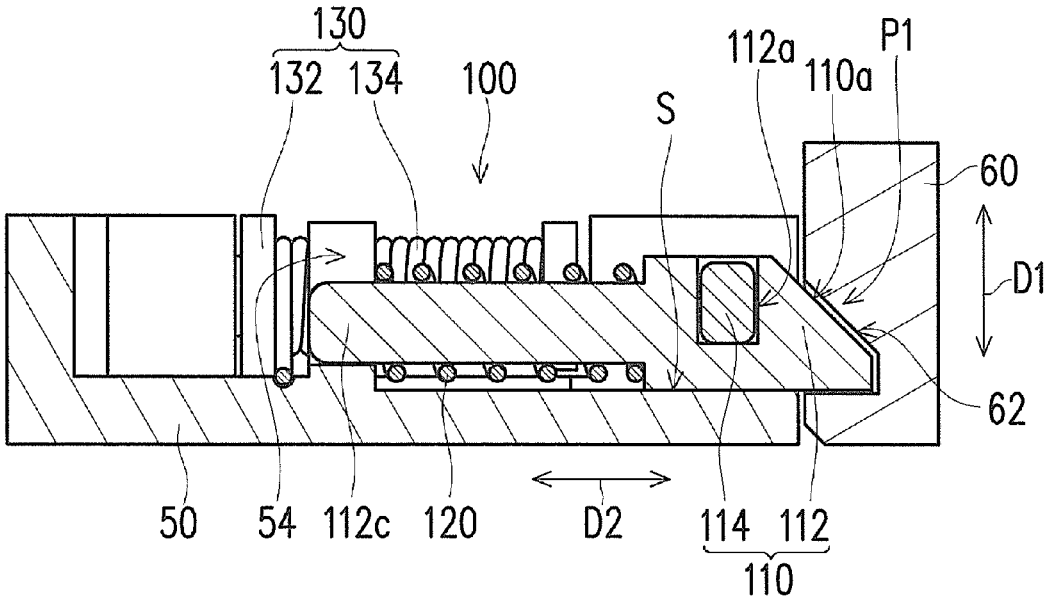
FIG. 3 is a cross-sectional diagram of the engaging structure illustrated in FIG. 1.
Figure 4:
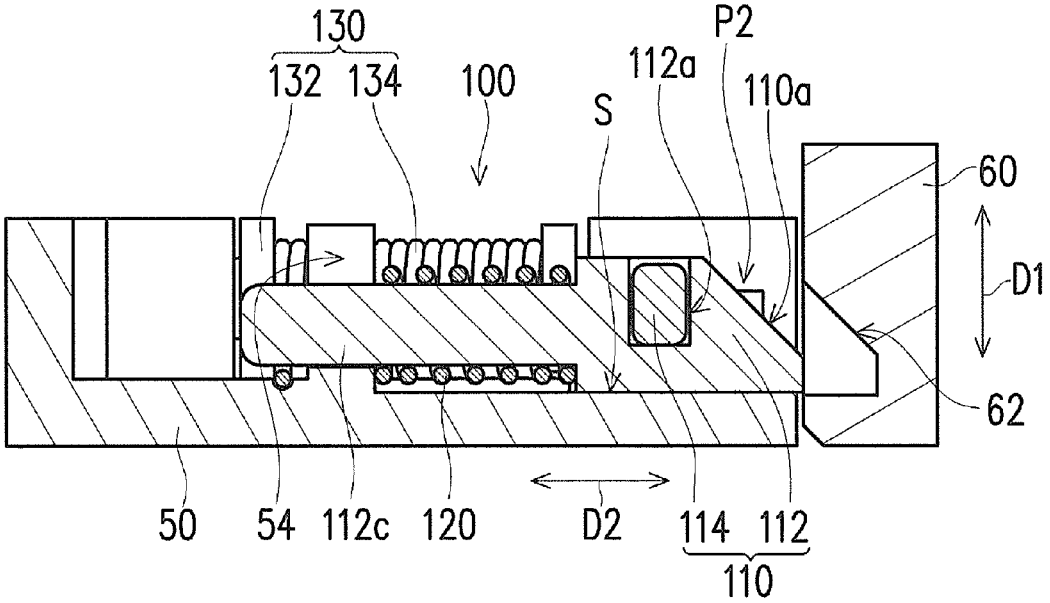
FIG. 4 is a cross-sectional diagram of the engaging structure illustrated in FIG. 2.

FIG. 3 is a cross-sectional diagram of the engaging structure illustrated in FIG. 1. FIG. 4 is a cross-sectional diagram of the engaging structure illustrated in FIG. 2. When the first object 50 and the second object 60 are combined, the engaging component 110 is adapted to move to a first position P1, as shown in FIG. 3 and to be positioned at the first position P1 through an elastic force of the elastic component 120. In this scenario, the engaging component 110 is engaged with the second object 60, such that the first object 50 and the second object 60 are fixed to each other. Additionally, when the first object 50 and the second object 60 are combined, the electromagnet 130 is energized, such that the electromagnet 130 generates a magnetic force, such that the engaging component 110 resists the elastic force of the elastic component 120 through the magnetic force generated by the electromagnet 130, as shown in FIG. 4, to move to and be positioned at the second position P2. In this scenario, the engaging component 110 is separated from the second object 60, such that the first object 50 and the second object 60 may be separated from each other.

Under the aforementioned disposition, the first object 50 and the second object 60 are assembled dissembled by the engaging module 100 through the movement of the engaging component 110, rather than through deformation of a hook in the way like the conventional hook does. Thus, the amount of interference between the engaging component 110 and the second object 60 interfered with each other is not limited to have larger amount of engagement and therefore, have better engaging capability. In addition, since the engaging module 100 is not operated through the elastic deformation of the engaging component 110 as described above, the minimum length of the engaging component 110 is not limited by the need of the elastic deformation, which contributes to thinning the appearance of an apparatus applying the engaging module 100. Moreover, in the engaging module 100, the engaging component 110 is driven to move by using the magnetic force generated by the electromagnet 130, instead of by using a force applied by a user, and thus, the engaging component 110 may be prevented from being fractured due to the force applied by the user. Meanwhile, the engaging component 110 does not have to be exposed for the user to apply the force, such that the apparatus applying the engaging module 100 may have better appearance.

To make the illustration more concise and clear, only partial structures of the first object 50 and the second object 60 are shown in the drawings. In the present embodiment, the first object 50 and the second object 60 may be, for example, two casings of an electronic apparatus. In other embodiments, the first object 50 and the second object 60 may be individually a display panel and its corresponding casing, a tablet computer and its corresponding docking station or any other objects that may be assembled to or disassembled from each other, which are not limited in the invention.

In the present embodiment, the first object 50 and the second object 60 are adapted to be combined or separated along a first axial direction D1. The engaging component 110 is adapted to move to the first position P1 and the second position P2 along a plane S, where the plane S is, for example, a structure surface of the first object 50 or any other adaptive reference plane. The first object 50 and the second object 60 are combined or separated along a direction (i.e., the first axial direction D1) perpendicular to a moving plane (i.e., the plane S) of the engaging component 110, such that the engaging component 110 will not be driven by the relative movement of the first object 50 and the second object 60 along the first axial direction D1 to reduce the risk of the engaging component 110 being accidentally separated from the second object 60. In other embodiments, the first axial direction D1 is not necessarily perpendicular to the plane S and may be any other adaptive direction that is not parallel to the plane S.

Figure 5A:
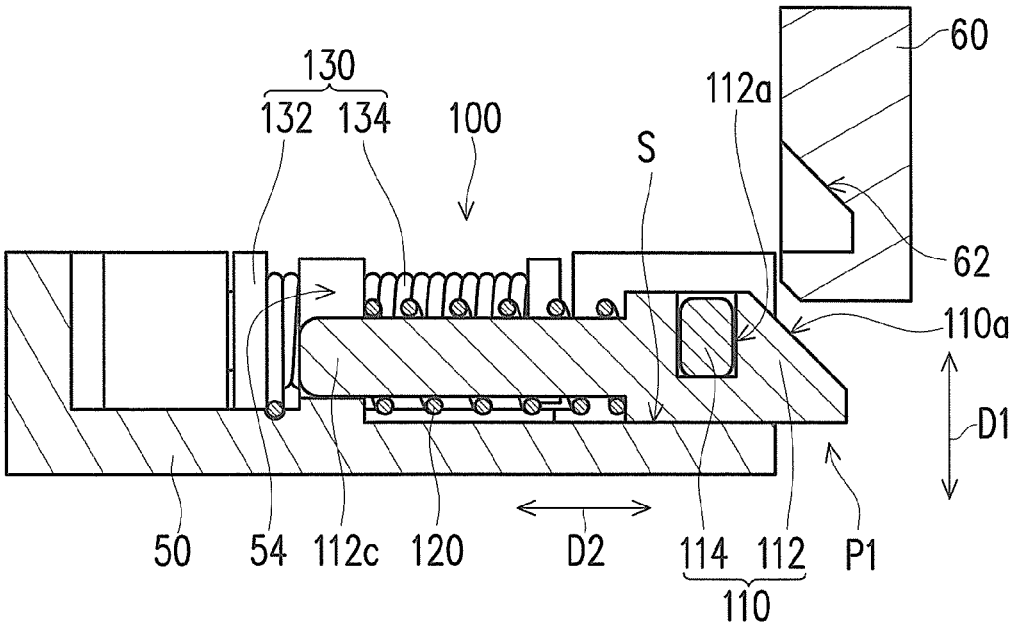
FIG. 5A and FIG. 5B are schematic diagrams illustrating a flow of combining the second object of FIG. 3 with the first object.
Figure 5B:
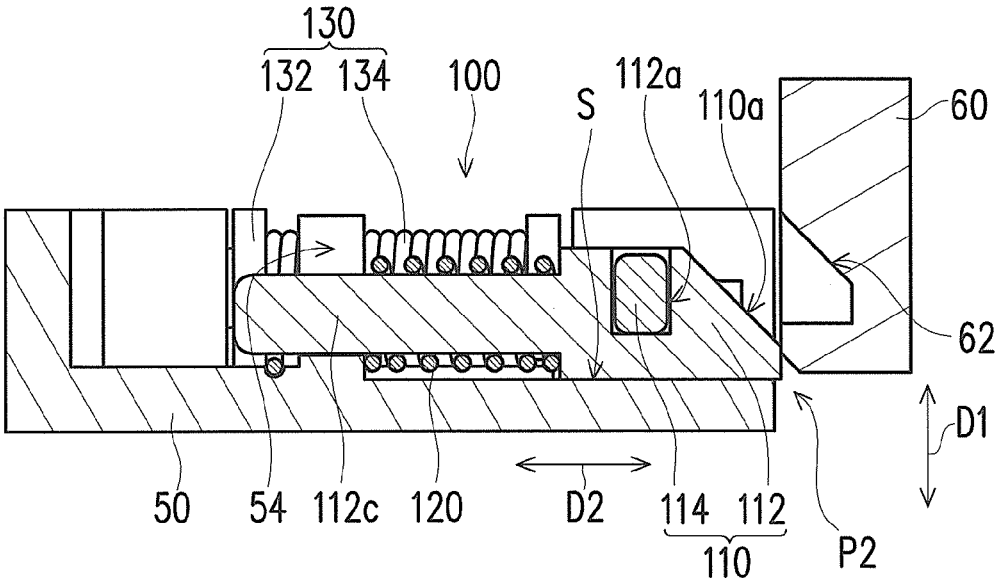

The combination of the first object 50 and the second object 60 will be described with reference to the drawings. FIG. 5A and FIG. 5B are schematic diagrams illustrating a flow of combining the second object of FIG. 3 with the first object. In the present embodiment, the second object 60 has an engaging slot 62, and the engaging component 110 has a guide surface 110*a*. The guide surface 110*a* is inclined with respect to the first axial direction D1 and the plane S. When a user wants to assemble the second object 60 to the first object 50, the user may move the second object 60 along the first axial direction D1 toward the first object 50, as shown in FIG. 5A to FIG. 5B, such that the second object 60 pushes the guide surface 110*a* of the engaging component 110 to drive the engaging component 110 to resist the elastic force of the elastic component 120 to move to the second position P2, as shown in FIG. 5B. Then, when the second object 60 continues to move along the first axial direction D1 to be combined with the first object 50, as shown in FIG. 3, the engaging component 110 is aligned to the engaging slot 62 of the second object 60 and moves to the first position P1 through the elastic force of the elastic component 120 to be engaged in the engaging slot 62. Thereby, the assembly of the first object 50 and the second object 60 is completed.

Furthermore, an engaging direction (i.e., a second axial direction D2) of the engaging slot 62 of the second object 60 is, for example, perpendicular to the direction (i.e., the first axial direction D1) for assembling/disassembling the first object 50 and the second object 60, such that the engagement of the engaging component 110 and the engaging slot 62 may securely stop the first object 50 and the second object 60 from being separated from each other. Accordingly, in the present embodiment, the direction (i.e., the first axial direction D1) for assembling/disassembling the first object 50 and the second object 60 is designed as being perpendicular to the moving plane S of the engaging component 110, such that the moving direction of the engaging component 110 is parallel to the engaging direction (i.e., the second axial direction D2) of the engaging slot 62 of the second object 60. Thus, the engaging component 110 may be smoothly engaged in the engaging slot 62 of the second object 60 along the second axial direction D2, without being designed in a form of a bending hook. Thereby, the issue of the hook fracture resulted from stress concentrated at the bending portion of the hook may be avoided.

Figure 6:
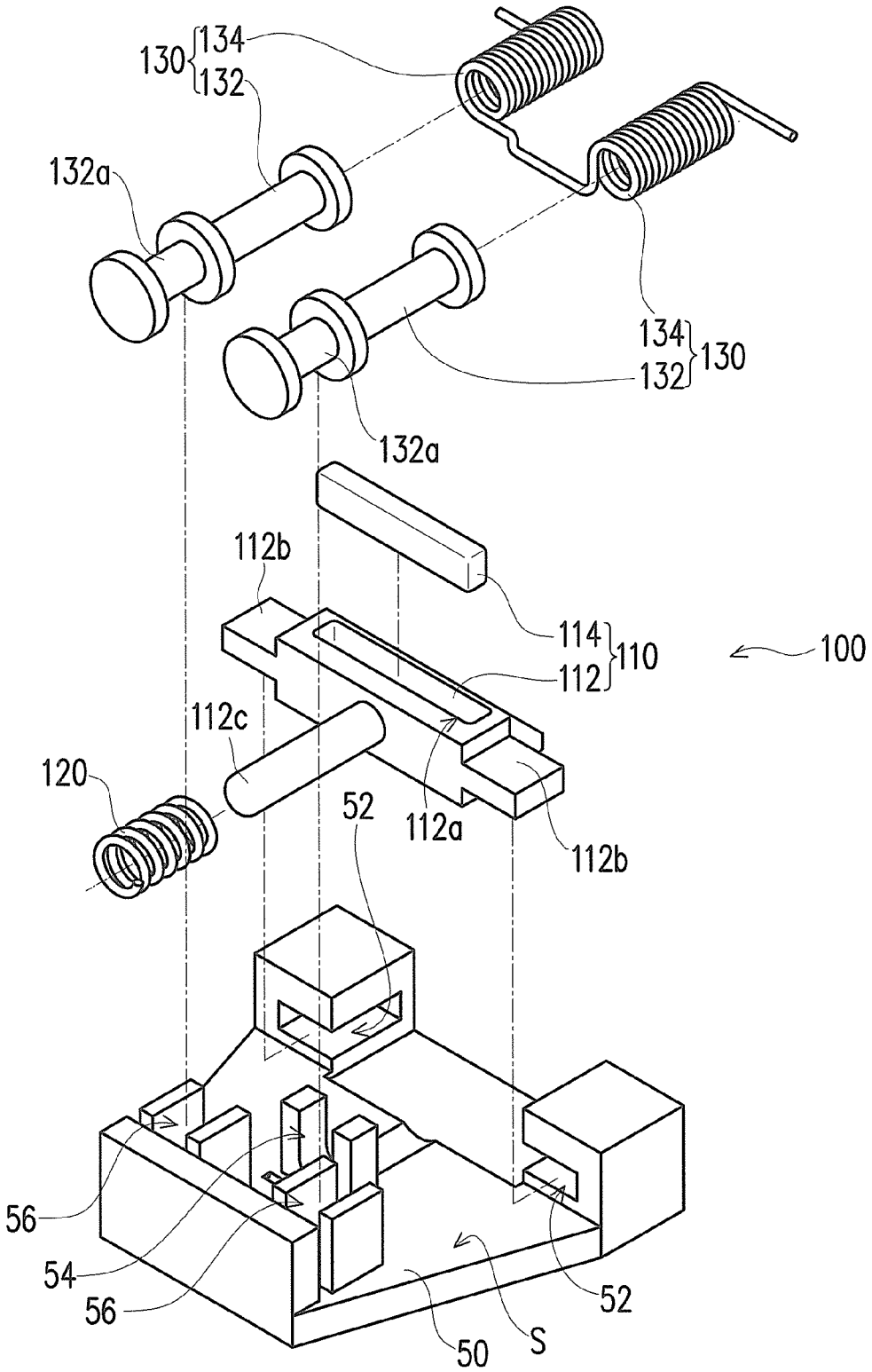
FIG. 6 is an exploded diagram illustrating the engaging module and the first object of FIG. 1.

Hereinafter, each component of the engaging module 100 of the present embodiment will be described with reference to the drawings. FIG. 6 is an exploded diagram illustrating the engaging module and the first object of FIG. 1. Referring to FIG. 1, FIG. 3 and FIG. 6, in the present embodiment, the engaging component 110 includes a main body 112 and a magnetized member 114. A material of the main body 112 is, for example, plastic or any other type of non-magnetized material. The main body 112 has a containing slot 112*a*. The magnetized member 114 is made of, for example, iron or any other magnetized metal and disposed in the containing slot 112*a*, such that the engaging component 110 may move to the second position P2 through the magnetic force of the electromagnet 130 attracting the magnetized member 114.

The first object 50 has two sliding slots 52 and a recess 54. The main body 112 of the engaging component 110 has two sliding blocks 112*b* and a pillar 112*c*. The two sliding blocks 112*b* slide along the second axial direction D2 in the two sliding slots 52, and the pillar 112*c* slides along the second axial direction D2 in the recess 54. In this case, the second axial direction D2 is parallel to the plane S. In other embodiments, the engaging component 110 may be slidably disposed on the first object 50, which is not limited in the invention. Additionally, the elastic component 120 is a compression spring fitted around the pillar 112*c*, and the two electromagnets 130 are respectively located at two opposite sides of the pillar 112*c* to generate an even magnetic force to attract the engaging component 110 and drive the engaging component 110 and the elastic component 120 to operate smoothly.

Each of the electromagnet 130 includes a magnetized member 132 and a coil 134. The coil 134 is wrapped around the magnetized member 132 and adapted to receive electricity to generate a magnetic field, such that the magnetized member 132 is magnetized to generate a magnetic attracting the engaging component 110. Additionally, the first object 50 has two fixing slots 56, each magnetized member 132 has a fixing portion 132*a*, and each fixing portion 132*a* is fixed to the corresponding fixing slot 56.

Figure 7A:
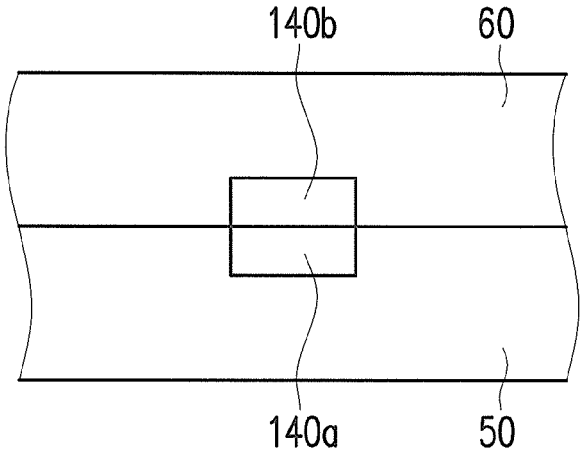
FIG. 7A is a partial schematic diagram illustrating the first object and the second object of FIG. 3.
Figure 7B:
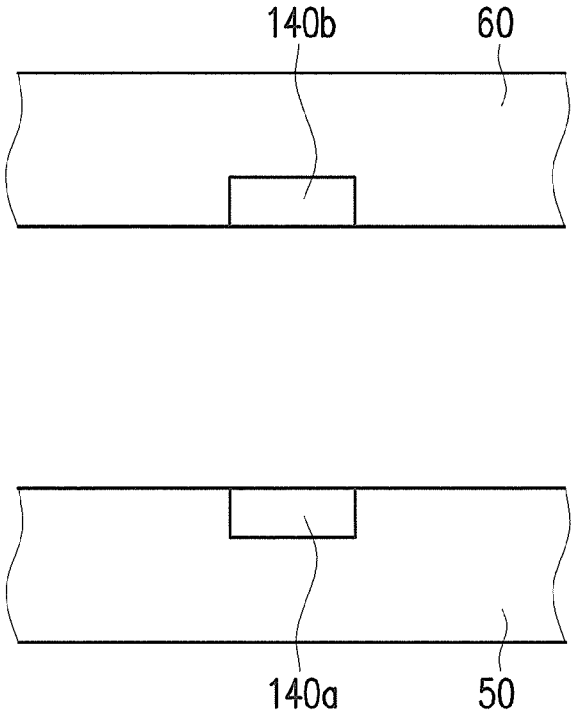
FIG. 7B is a partial schematic diagram illustrating the first object and the second object of FIG. 5A.

FIG. 7A is a partial schematic diagram illustrating the first object and the second object of FIG. 3. FIG. 7B is a partial schematic diagram illustrating the first object and the second object of FIG. 5A. Referring to FIG. 7A and FIG. 7B, in the present embodiment, the engaging module 100 (illustrated in FIG. 1 to FIG. 6) further includes a first electrical connection portion 140*a* and a second electrical connection portion 140*b*. The first electrical connection portion 140*a* is disposed on the first object 50 and electrically connected with the electromagnets 130 (illustrated in FIG. 1 to FIG. 6). The second electrical connection portion 140*b* is disposed on the second object 60 and electrically connected with a power supply. When the first object 50 and the second object 60 are combined, as shown in FIG. 3 and FIG. 7A, the first electrical connection portion 140*a* contacts the second electrical connection portion 140*b*. In this scenario, the electromagnets 130 are adapted to receive electricity from the power supply through the first electrical connection portion 140*a* and the second electrical connection portion 140*b* to generate the magnetic force to drive the engaging component 110 to separate from the second object 60. When the first object 50 and the second object 60 are separated, as shown in FIG. 5A and FIG. 7B, the first electrical connection portion 50 does not contact the second electrical connection portion 60 to prevent the electromagnets 130 from being overheated due to continuously receiving the electricity from the power supply through the first electrical connection portion 140*a* and the second electrical connection portion 140*b*. In other embodiments, whether the electromagnets 130 are energized may be controlled by other adaptive switches or sensing elements, which are not limited in the invention.

Figure 8:
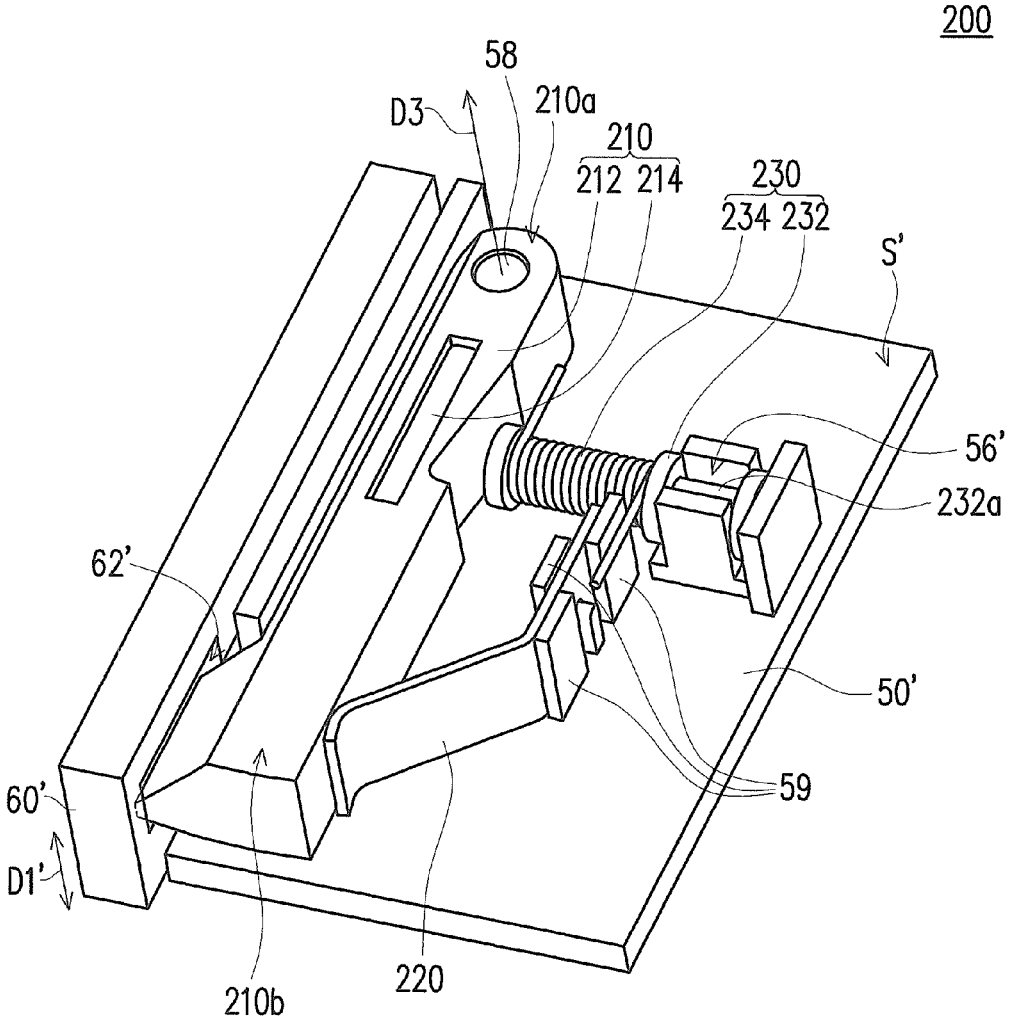
FIG. 8 is a perspective diagram illustrating an engaging structure according to another embodiment of the invention.
Figure 9:
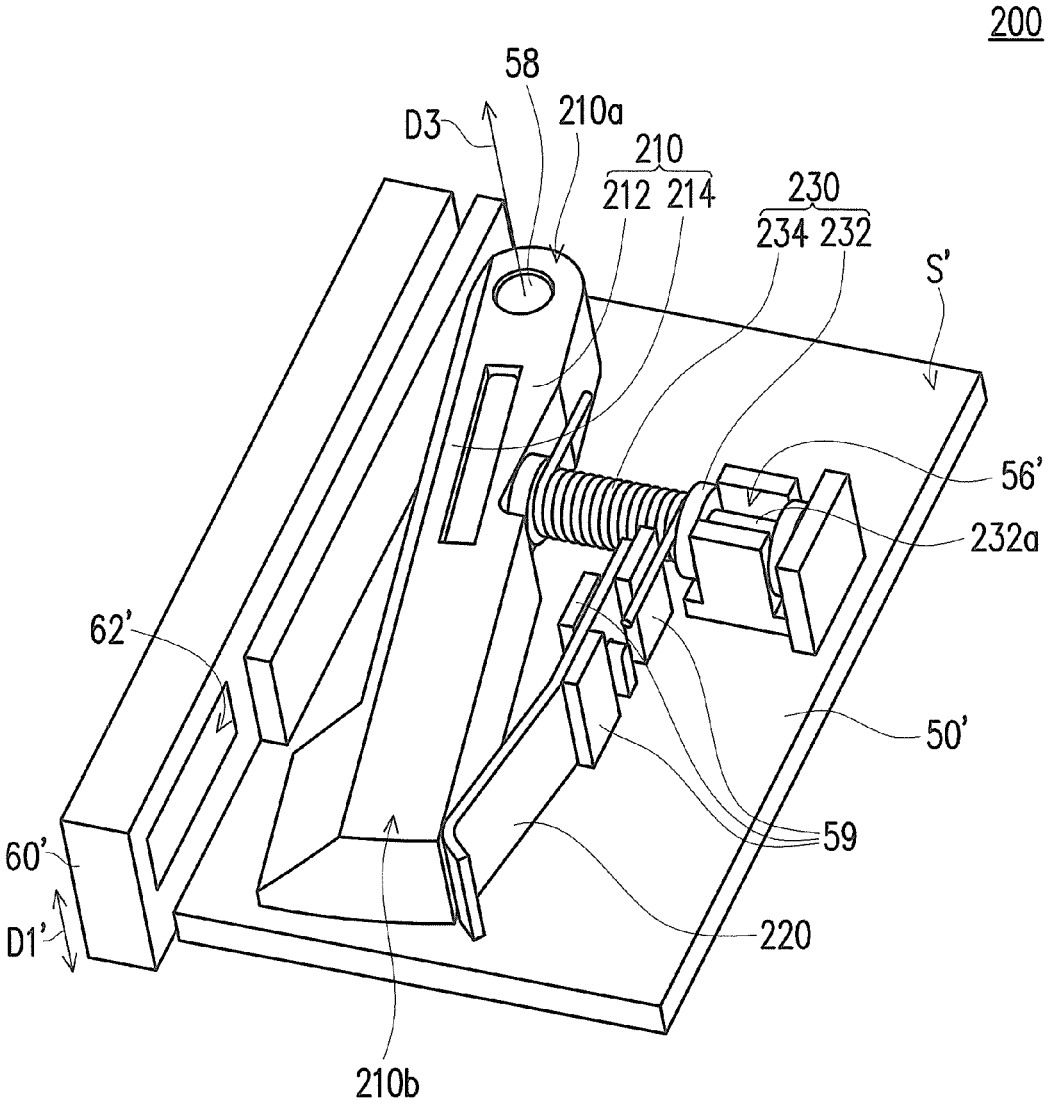
FIG. 9 illustrates a scenario that the engaging component of FIG. 8 is separated from the second object.

FIG. 8 is a perspective diagram illustrating an engaging structure according to another embodiment of the invention. FIG. 9 illustrates a scenario that the engaging component of FIG. 8 is separated from the second object. In an engaging module 200 of the present embodiment, a first object 50', a fixing slot 56', a second object 60', an engaging slot 62', an engaging component 210, a main body 212, a magnetized member 214, an elastic component 220, an electromagnet 230, a magnetized member 232, a fixing portion 232*a*, a coil 234, a plane S', and a first axial direction D1' are disposed and operated similarly to the first object 50, the fixing slot 56, the second object 60, the engaging slot 62, the engaging component 110, the main body 112, the magnetized member 114, the elastic component 120, the electromagnet 130, the magnetized member 132, the fixing portion 132*a*, the coil 134, the plane S, and the first axial direction D1 illustrated in FIG. 1 to FIG. 6 and thus, will not be repeatedly described hereinafter.

The engaging module 200 is different from the engaging module 100 in that the first object 50' has a pivot 58, and the engaging component 210 has a pivoted end 210*a* and a free end 210*b*. The engaging component 210 is not slidably disposed on the first object 50', but is pivoted to the pivot 58 of the first object 50' along a third axial direction D3 through the pivoted end 210*a*. The third axial direction D3 is perpendicular to the moving plane (i.e., the plane S') of the engaging component 210. Additionally, the elastic component 220 is not a compression spring, but an elastic piece. The elastic piece leans against the free end 210*b* of the engaging component 210, such that the engaging component 210 is positioned through an elastic force of the elastic component 220 in a state shown in FIG. 8 to be engaged in the engaging slot 62' of the second object 60'. The engaging component 210 is adapted to resist the elastic force of the elastic component 220 through a magnetic force generated by the electromagnet 230 to pivotally rotate to the a state shown in FIG. 9 to separate from the second object 60'. Thereby, the first object 50' and the second object 60' may be separated from each other.

In the embodiment illustrated in FIG. 8 and FIG. 9, the number of the electromagnet 230 is, for example, one. In other embodiments, the electromagnet 230 may be in any other appropriate number, but the invention is not limited thereto. Additionally, the first object 50' has a positioning rib 59 use to fix the elastic component 220 to the first object 50'. In other embodiments, the elastic component 220 may be fixed by using any other adaptive structure, and the invention is not limited thereto.

Figure 10:
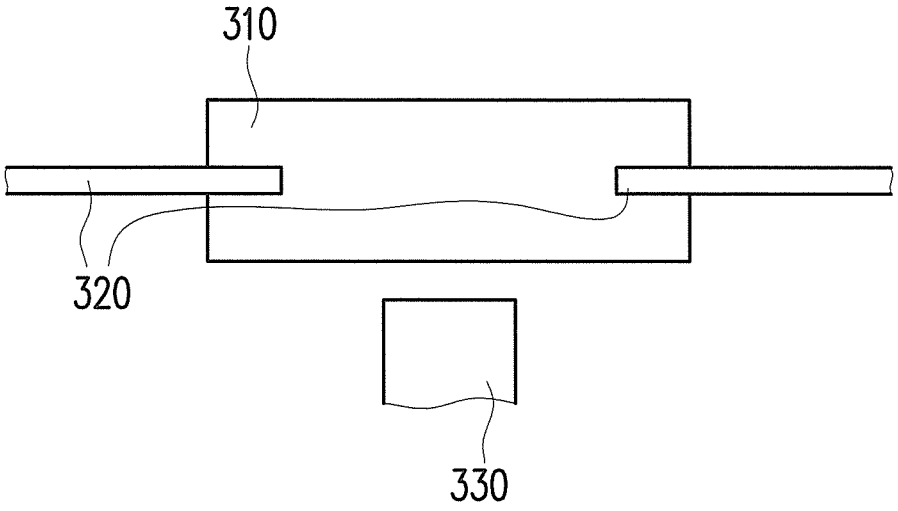
FIG. 10 is a perspective diagram illustrating part of components of an engaging module according to another embodiment of the invention.

FIG. 10 is a perspective diagram illustrating part of components of an engaging module according to another embodiment of the invention. In the embodiment illustrated in FIG. 10, an engaging component 310, an elastic component 320, and an electromagnet 330 is operated similarly to the engaging component 110, the elastic component 120, and the electromagnet 130 illustrated in FIG. 1 and thus, will not be repeatedly described hereinafter. The embodiment illustrated in FIG. 10 is different from the embodiment illustrated in FIG. 1 in that the engaging component 310 is not composed of the main body 112 and the magnetized member 114 as the engaging component 110 illustrated in FIG. 1, and the engaging component 310 is an integrally formed magnetized member. The elastic component 320 includes two elastic arms respectively connected with two opposite sides of the engaging component 310. The electromagnet 330 is adapted to drive the engaging component 310 to resist an elastic force of the elastic component 320 through a magnetic force generated to the engaging component 310.

In light of the foregoing, the assembly and disassembly of the objects is performed by the engaging module through the movement of the engaging component in the invention, instead of by using the deformation of the hook itself in the way like the conventional hook does. Thus, the amount of interference between the engaging component and the object interfered with each other is not limited and therefore, have better engaging capability. In addition, since the engaging module is not operated through the elastic deformation of the engaging component as described above, the minimum length of the engaging component is not limited by the need of the elastic deformation, which contributes to thinning the appearance of an apparatus applying the engaging module. Moreover, in the engaging module of the invention, the engaging component is driven to move by using the magnetic force generated by the electromagnet, instead of by using a force applied by a user, and thus, the engaging component can be prevented from being fractured due to the force applied by the user. Meanwhile, the engaging component does not have to be exposed for the user to apply the force, such that the apparatus applying the engaging module may have better appearance. Moreover, the direction along which the first object and the second object are combined or separated is designed as being perpendicular to the moving plane of the engaging component, such that the engaging component is not driven to move due to the relative movement of the first object and the second object, such that the risk of the engaging component being accidentally separated from the second object can be reduced.

Although the invention has been described with reference to the above embodiments, it will be apparent to one of the ordinary skill in the art that modifications to the described embodiment may be made without departing from the spirit of the invention. Accordingly, the scope of the invention will be defined by the attached claims not by the above detailed descriptions.

What is claimed is:

1. An engaging module, suitable for a first object and a second object, the first object and the second object being adapted to be combined or separated along a first axial direction, the engaging module comprising:

an engaging component, movably disposed on the first object, wherein when the first object and the second object are combined, the engaging component is adapted to move to a first position along a plane to be engaged with the second object and adapted to move to a second position along the plane to separate from the second object, wherein the first axial direction is not parallel to the plane;

an elastic component, connected between the engaging component and the first object, wherein the engaging component is positioned at the first position through an elastic force of the elastic component;

at least one electromagnet, disposed on the first object, wherein the engaging component is adapted to resist the elastic force of the elastic component to be positioned at the second position through a magnetic force generated by the electromagnet;

a first electrical connection portion; and a second electrical connection portion, wherein the first electrical connection portion is disposed on the first object and electrically connected with the electromagnet, the second electrical connection portion is disposed on the second object and electrically connected with a power supply, when the first object and the second object are combined, the first electrical connection portion contacts the second electrical connection portion, such that the electromagnet is adapted to receive electricity from the power supply, and when the first object is separated from the second object, the first electrical connection portion does not contact the second electrical connection portion.

2. The engaging module according to claim 1, wherein the first axial direction is perpendicular to the plane.

3. The engaging module according to claim 2, wherein the second object has an engaging slot, when the second object moves along the first axial direction toward the first object, the second object pushes the engaging component to drive the engaging component to resist the elastic force of the elastic component to move toward the second position, and when the second object is combined with the first object, the engaging component is aligned to the engaging slot and moves to the first position through the elastic force of the elastic component to be engaged with the engaging slot.

4. The engaging module according to claim 1, wherein the second object has an engaging slot, when the second object moves along the first axial direction toward the first object, the second object pushes the engaging component to drive the engaging component to resist the elastic force of the elastic component to move toward the second position, and when the second object is combined with the first object, the engaging component is aligned to the engaging slot and moves to the first position through the elastic force of the elastic component to be engaged with the engaging slot.

5. The engaging module according to claim 4, wherein the engaging component has a guide surface, the guide surface is inclined with respect to the first axial direction and the plane, and the second object is adapted to push the guide surface to drive the engaging component to resist the elastic force of the elastic component to move toward the second position.

6. The engaging module according to claim 4, wherein a material of the engaging component comprises a magnetized material.

7. The engaging module according to claim 4, wherein the engaging component comprises a main body and a magnetized member, the main body has a containing slot, and the magnetized member is disposed in the containing slot.

8. The engaging module according to claim 4, wherein the engaging component is slidably disposed on the first object along a second axial direction, and the second axial direction is parallel to the plane.

9. The engaging module according to claim 8, wherein the engaging component has a pillar extending along the second axial direction, and the elastic component is a compression spring fitted around the pillar.

10. The engaging module according to claim 4, wherein the engaging component is pivoted to the first object along a third axial direction, and the third axial direction is perpendicular to the plane.

11. The engaging module according to claim 10, wherein the engaging component has a pivoted end and a free end, the pivoted end is pivoted to the first object along the third axial direction, and the elastic component is an elastic piece and leans against the free end.

12. The engaging module according to claim 1, wherein a material of the engaging component comprises a magnetized material.

13. The engaging module according to claim 1, wherein the engaging component comprises a main body and a magnetized member, the main body has a containing slot, and the magnetized member is disposed in the containing slot.

14. The engaging module according to claim 1, wherein the engaging component is slidably disposed on the first object along a second axial direction, and the second axial direction is parallel to the plane.

15. The engaging module according to claim 14, wherein the engaging component has a pillar, the pillar extends along the second axial direction, and the elastic component is a compression spring fitted around the pillar.

16. The engaging module according to claim 15, wherein the number of the at least one electromagnet is two, and the two electromagnets are respectively located on two opposite sides of the pillar.

17. The engaging module according to claim 1, wherein the engaging component is pivoted to the first object along the third axial direction, and the third axial direction is perpendicular to the plane.

18. The engaging module according to claim 17, wherein the engaging component has a pivoted end and a free end, the pivoted end is pivoted to the first object along the third axial direction, and the elastic component is an elastic piece and leans against the free end.

* * * * *